US006076747A

United States Patent [19]

Ming-Yuan

[11] Patent Number: 6,076,747

[45] Date of Patent: Jun. 20, 2000

[54] SPRAY-ADJUSTMENT STRUCTURE OF SHOWER HEAD

[76] Inventor: Hsu Ming-Yuan, No. 165, Lane 421, Section 2, Ting Tsao Road, Lu Kang Township, Chang Hua Hsien, Taiwan

[21] Appl. No.: 09/332,439

[22] Filed: Jun. 14, 1999

[51] Int. Cl.[7] ..... B05B 1/12

[52] U.S. Cl. ..... 239/383; 239/438; 239/541; 239/460; 239/587.4

[58] Field of Search ..... 239/380, 383, 239/436–438, 451, 456, 460, 537–539, 541, 394, 556, 558, 560, 587.4

[56] References Cited

U.S. PATENT DOCUMENTS

| | | | |
|---|---|---|---|
| 5,356,077 | 10/1994 | Shames et al. | 239/383 |
| 5,518,181 | 5/1996 | Shames et al. | 239/438 X |
| 5,647,537 | 7/1997 | Bergmann | 239/383 |

*Primary Examiner*—Lesley D. Morris

*Attorney, Agent, or Firm*—Harrison & Egbert

[57] ABSTRACT

A shower head having a front body, a movable circular body, an action member, a clamping member, a rotating seat, a locating member, a pull member, a valve, a tube connecting member, and a shell. The front body is provided with a plurality of water emitting holes which are completely separated from the vibrating water discharging hole of the front body by a washer of the movable circular body and a circular frame of the front body. The water emitting holes of the front body and the water-spraying grooves of the movable circular body share a common water pathway due to the fact that the washer of the movable circular body is located between the water-spraying grooves of the movable circular body and the water-admitting holes of the movable circular body, in conjunction with the circular protrusion of the rotating seat. The locating member is securely located between the second stepped edge of the clamping member and the threaded protrusion of the shell due to the fact that a self-locking edge of the clamping member is engaged with a self-locking portion of the shell.

1 Claim, 10 Drawing Sheets

SPRAY-ADJUSTMENT STRUCTURE OF SHOWER HEAD

FIELD OF THE INVENTION

The present invention relates generally to a shower head, and more particularly to a spray-adjustment structure of the shower head.

BACKGROUND OF THE INVENTION

As shown in FIGS. 1, 2, and 3, a shower head of the prior art comprises a plurality of component parts, which are described hereinafter.

A disk body 1 is provided with a water discharging hole 12, a shaft tube 14 which is in turn provided with a vibrating member 16 and a water flow orienting member 19. The vibrating member 16 is provided with a rotating plate 17 and a baffle 18. The water flow orienting member 19 is provided with a plurality of slots 20 corresponding to the rotating plate 17, and a through hole 21.

A ring piece 22 is provided with a through hole 23 and a plurality of radial ribs 24. The vibrating member 16 and the water flow orienting member 19 are disposed in the ring piece 22 in conjunction with a washer 27. The ring piece 22 is provided with a plurality of water emitting grooves 28 and a sealing ring 30 disposed on the back edge of the through hole 23.

An action ring 31 is provided with ribs 32 and a plurality of moving edges 33.

A clamping ring 34 is engaged with the action ring 31 and provided with a first stepped edge 35, a second stepped edge 36, and inner threads 37.

A rotating seat 39 is provided with a circular protruded edge 40 corresponding to the clamping ring 34, a plurality of recesses 41 corresponding to the ribs 32 of the action ring 31, and a fitting hole 42 which is in turn provided with a sealing ring 43 and a moving rib 44. The rotating seat 39 is further provided with a rotating pillar 45.

A locating disk 47 is disposed in the second stepped edge 36 of the clamping ring 34 and is provided in the center thereof with a tubular portion 48 having ribs 49 and an inner stepped edge 50. The locating disk 47 is provided with a plurality of arresting pillars 51.

A pull member 52 is provided with a longitudinally oriented slide slot 53 corresponding to the moving rib 44 of the rotating seat 39. The pull member 52 is further provided with a tubular seat 55 having a spiral groove 54 and a movable washer 56 disposed in the fitting hole 42 of the pull member 52. The axial hole 57 of the pull member 52 is provided therein with a column 58. The front end of the pull member 52 is in an intimate contact with the sealing ring 30 of the through hole 23. The column 58 urges the water flow orienting member 19 such that a bolt 59 is put through the shaft tube 14 and the through hole 21 of the water flow orienting member 19.

A valve 60 is disposed such that the valve 60 is corresponding in location to the axial hole 57 of the pull member 52, and that the valve 60 is provided with a washer 61. The valve 60 is provided in a rear end thereof with a support ring 62.

A tube connecting member 63 is provided therein with threads 64 and is further provided at the front end thereof with a spherical body 66 having a water admitting hole 65.

A shell 67 is provided at one end thereof with an end portion 68 for receiving the tube connecting member 63. The shell 67 is further provided with a threaded circular portion 69 corresponding in location to the inner threads 37 of the clamping member 34. The locating disk 47 is located between the second stepped edge 36 and the threaded circular portion 69.

Such a prior art shower head as described above is defective in design in that the water is let out by the water discharging hole 12 and the water emitting grooves 28. In light of the movable washer 56 of the pull member 52 displacing between the fitting hole 42 of the rotating seat 39 and the washer 61 of the valve 60 for controlling the flow of water out of the water discharging hole 12, as shown in FIGS. 4 and 5, or adjusting the flow of water out of the water emitting grooves 28. The water flow is not strong enough to have a showering effect. In addition, the clamping ring 34 is prone to become loosened to result in the simultaneous rotation of the locating disk 47 and the locating seat 39.

SUMMARY OF THE INVENTION

The primary objective of the present invention is therefore to provide a shower head with a spray-adjustment structure which is free from the deficiencies of the shower head of the prior art described above.

In keeping with the principle of the present invention, the foregoing objective of the present invention is attained by an improved shower head which is composed of a plurality of component parts free from the risk of becoming loosened and is capable of spraying water in various ways. The present invention is provided with a circular frame which is located between a water emitting hole and a water discharging hole, and a clamping member having a self-locking surface for engaging securely a shell.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
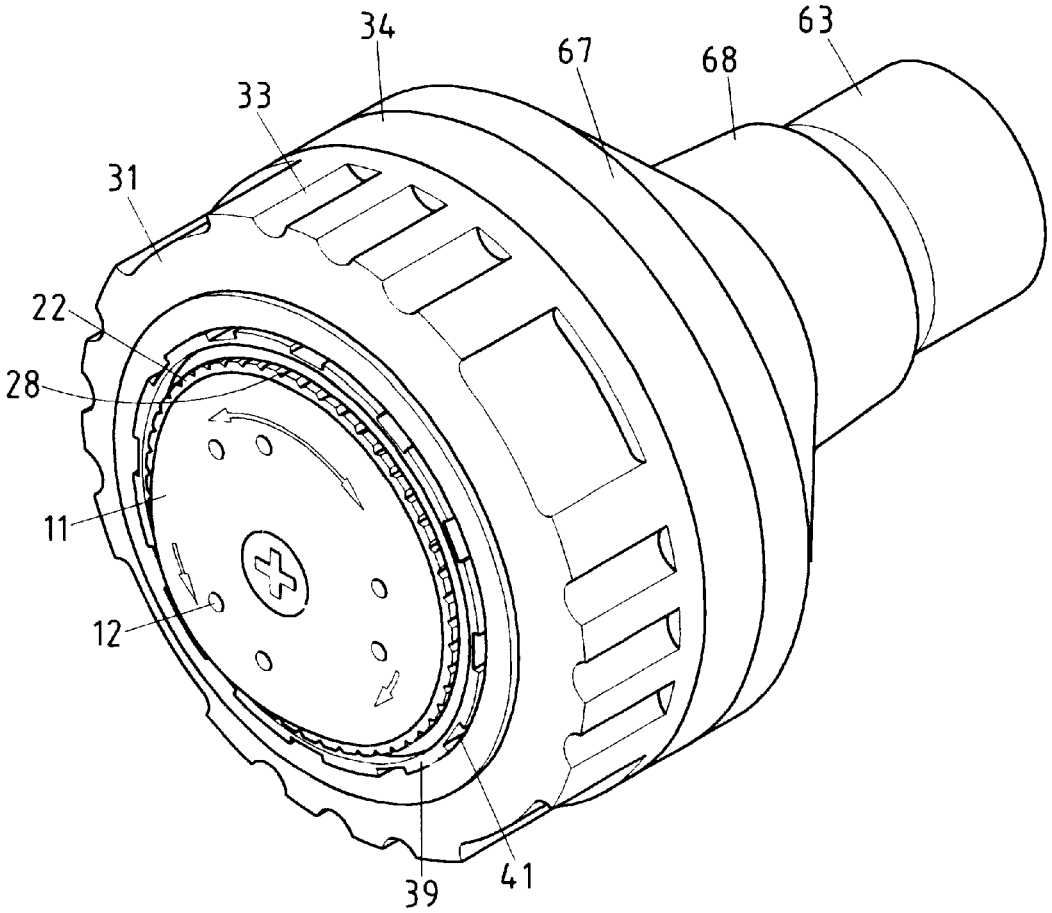
FIG.1 (PRIOR ART)
FIG. 1 shows a perspective view of a shower head of the prior art.
Figure 2:
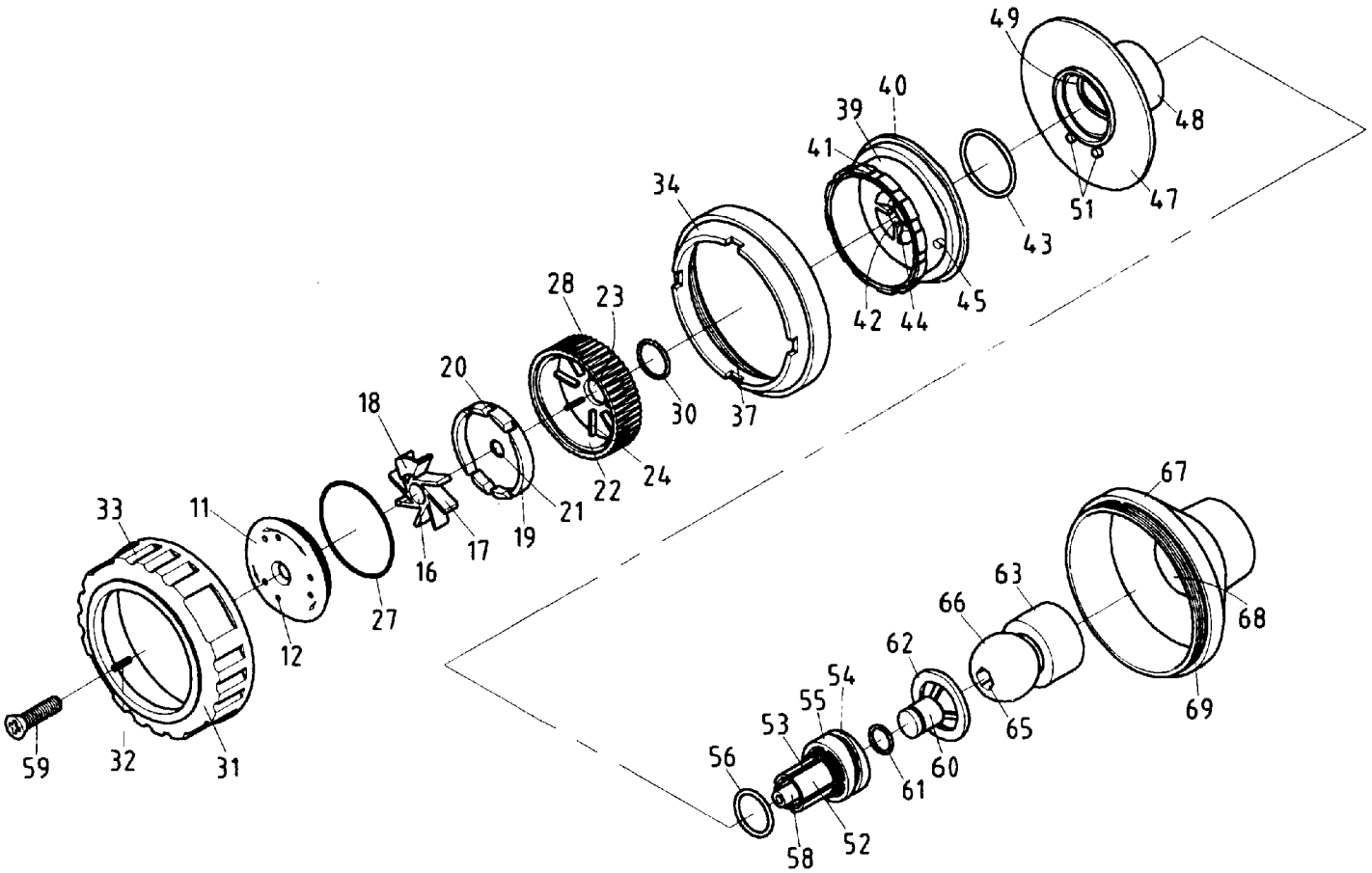
FIG. 2 (PRIOR ART)
FIG. 2 shows an exploded view of the shower head of the prior art.
Figure 3:
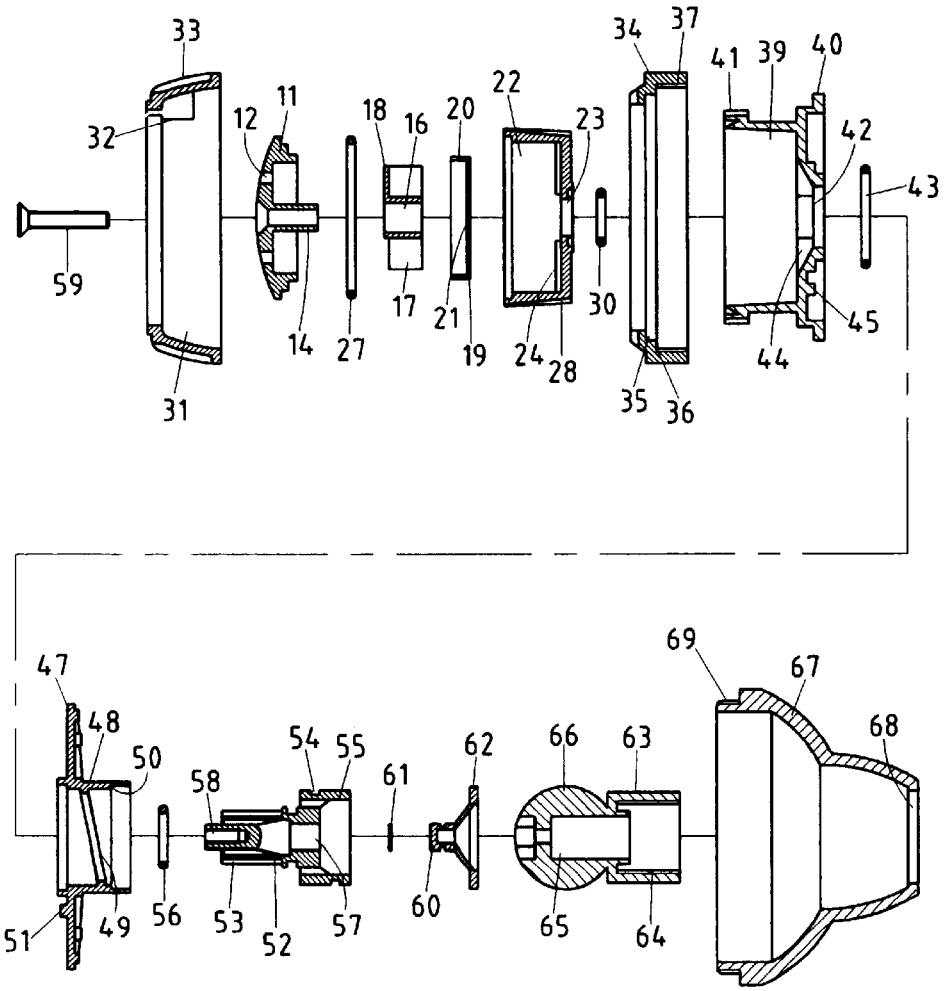
FIG. 3 (PRIOR ART)
FIG. 3 shows a longitudinal sectional view of the shower head of the prior art.
Figure 4:
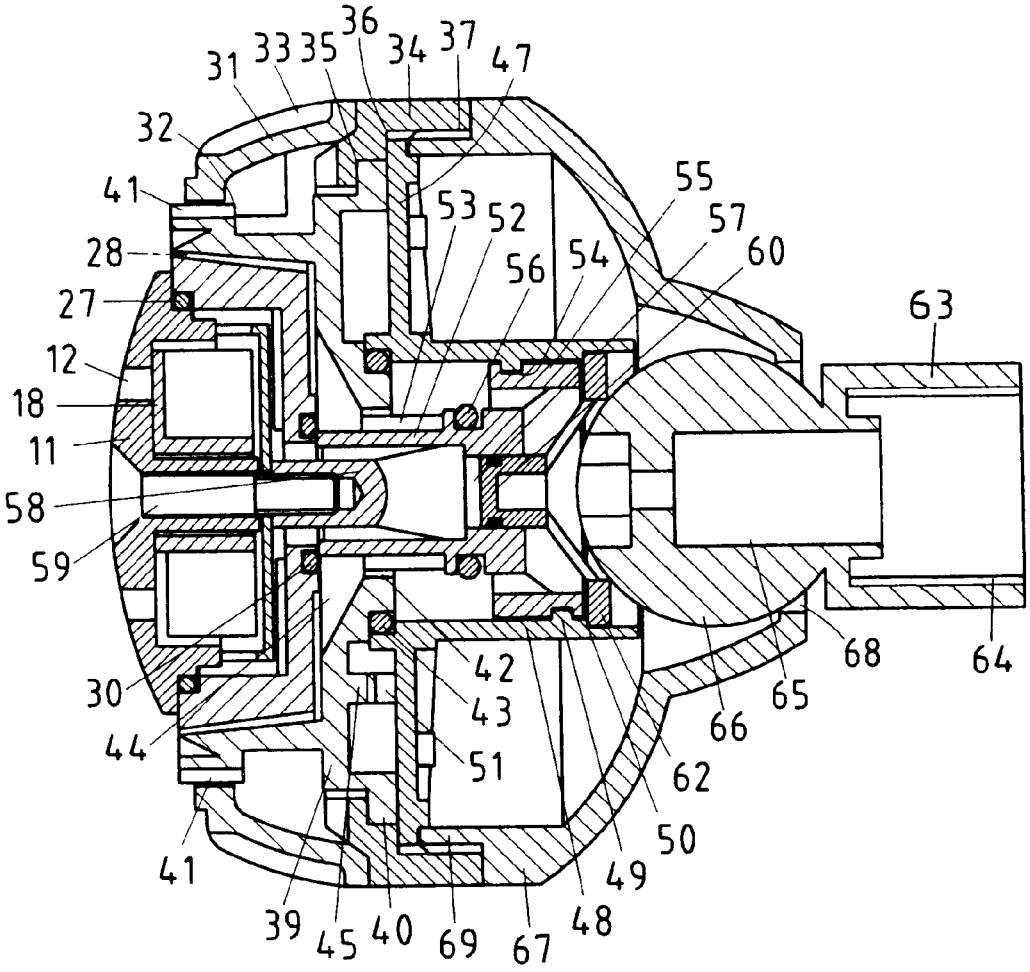
FIG.4 (PRIOR ART)
FIG. 4 shows a longitudinal sectional view of the shower head of the prior art in combination.
Figure 5:
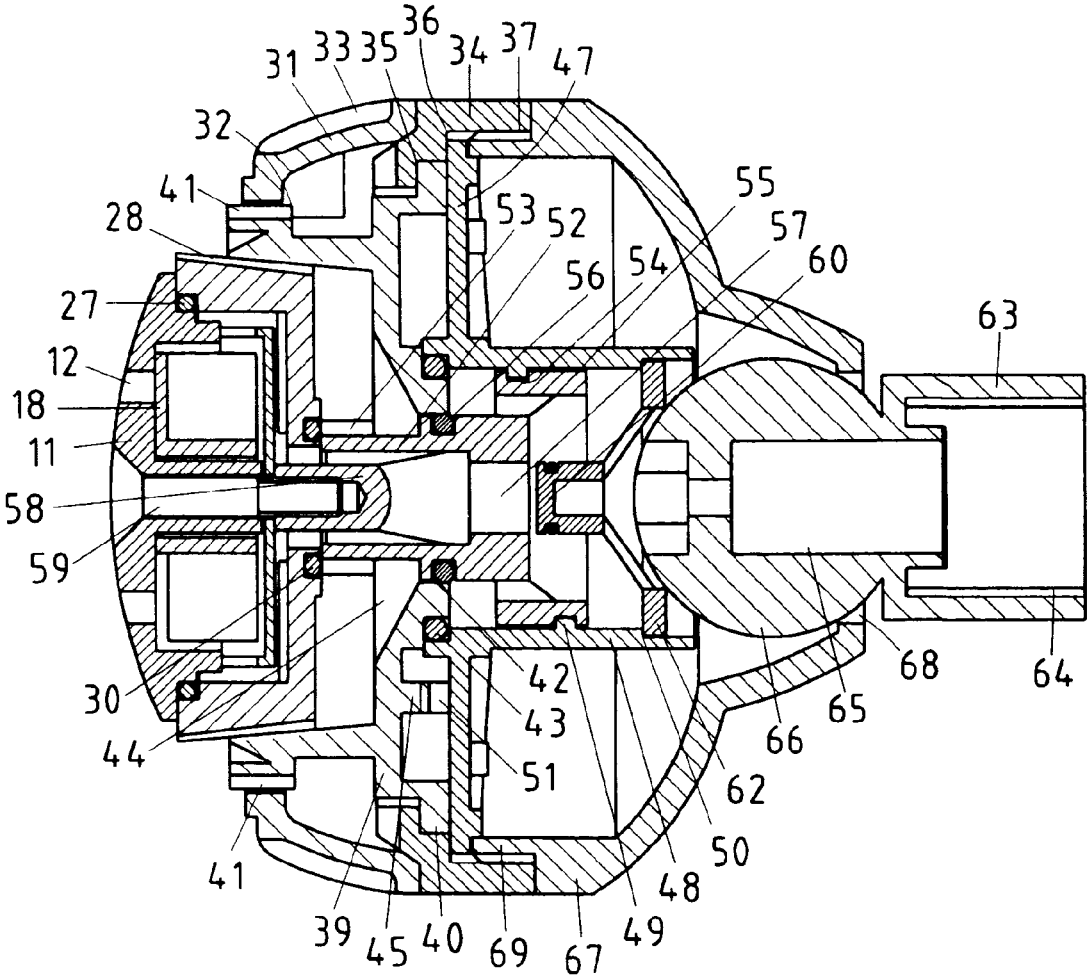
FIG.5 (PRIOR ART)
FIG. 5 shows another longitudinal sectional view of the shower head of the prior art in combination.
Figure 6:
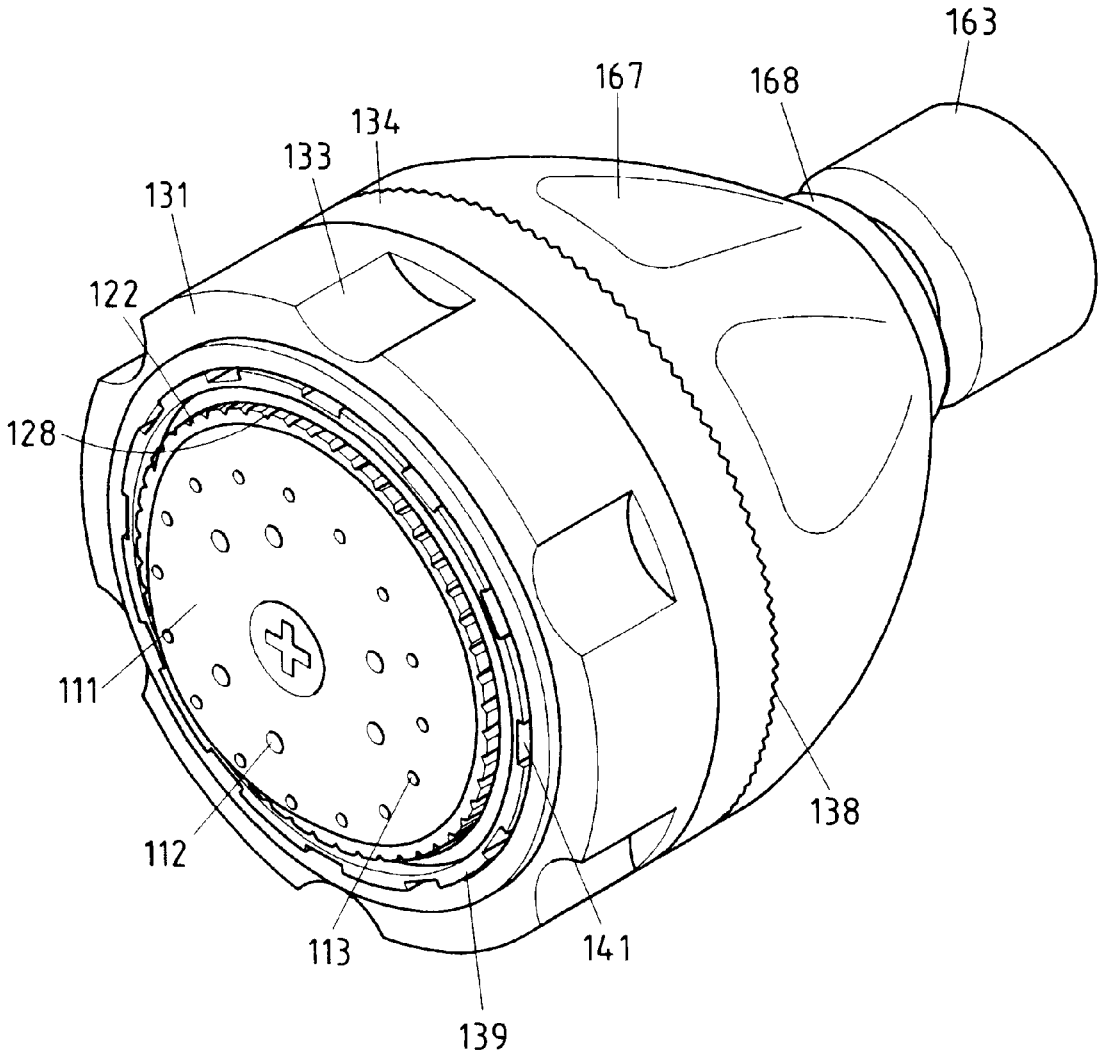
FIG. 6 shows a perspective view of a shower head of the present invention.
Figure 7:
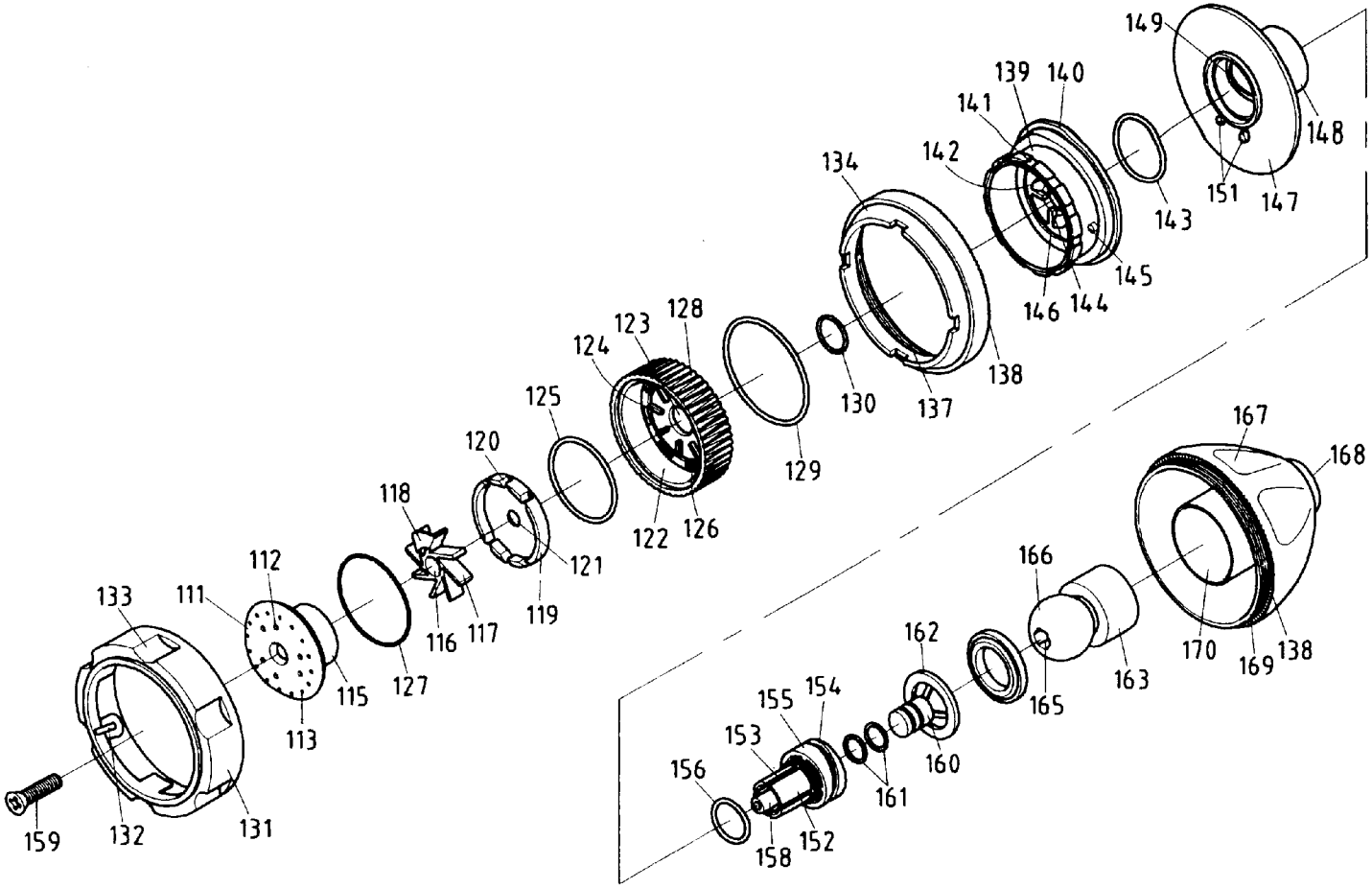
FIG. 7 shows an exploded view of the shower head of the present invention.
Figure 8:
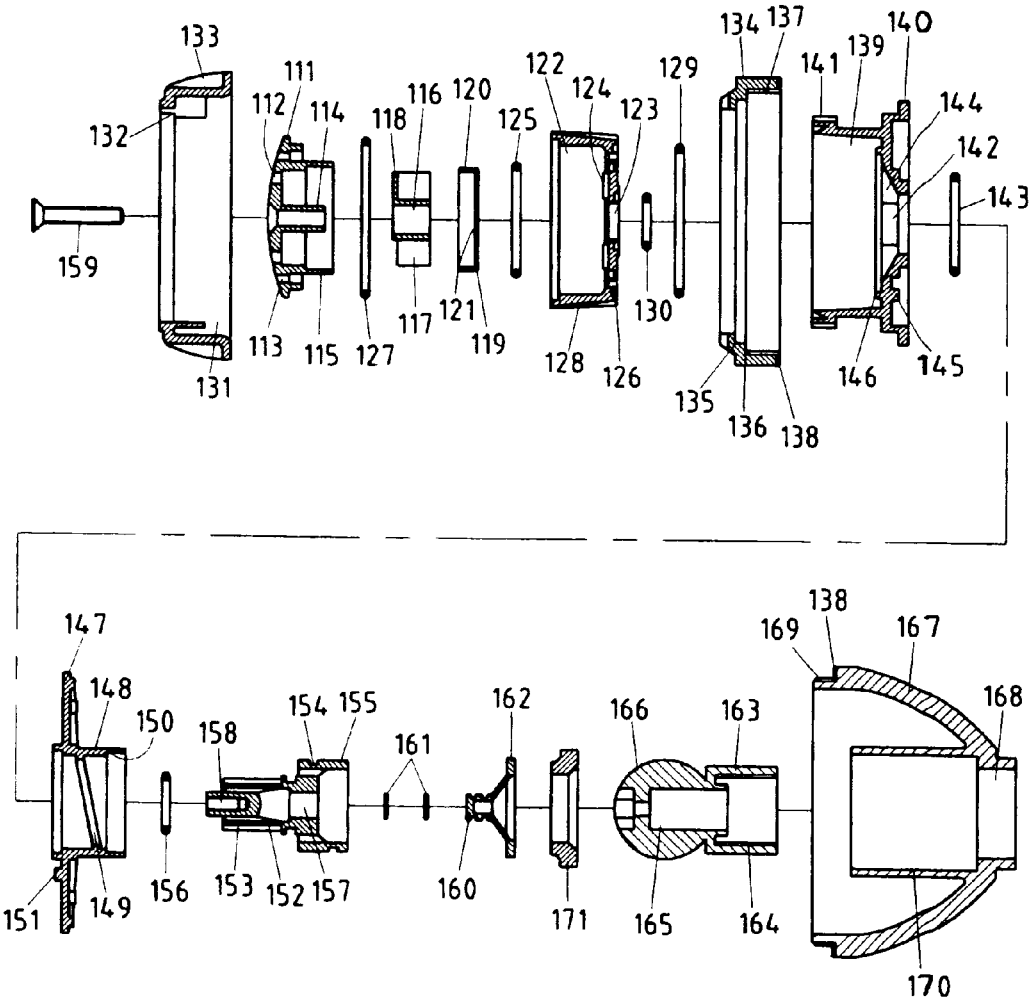
FIG. 8 shows another exploded view of the shower head of the present invention.
Figure 9:
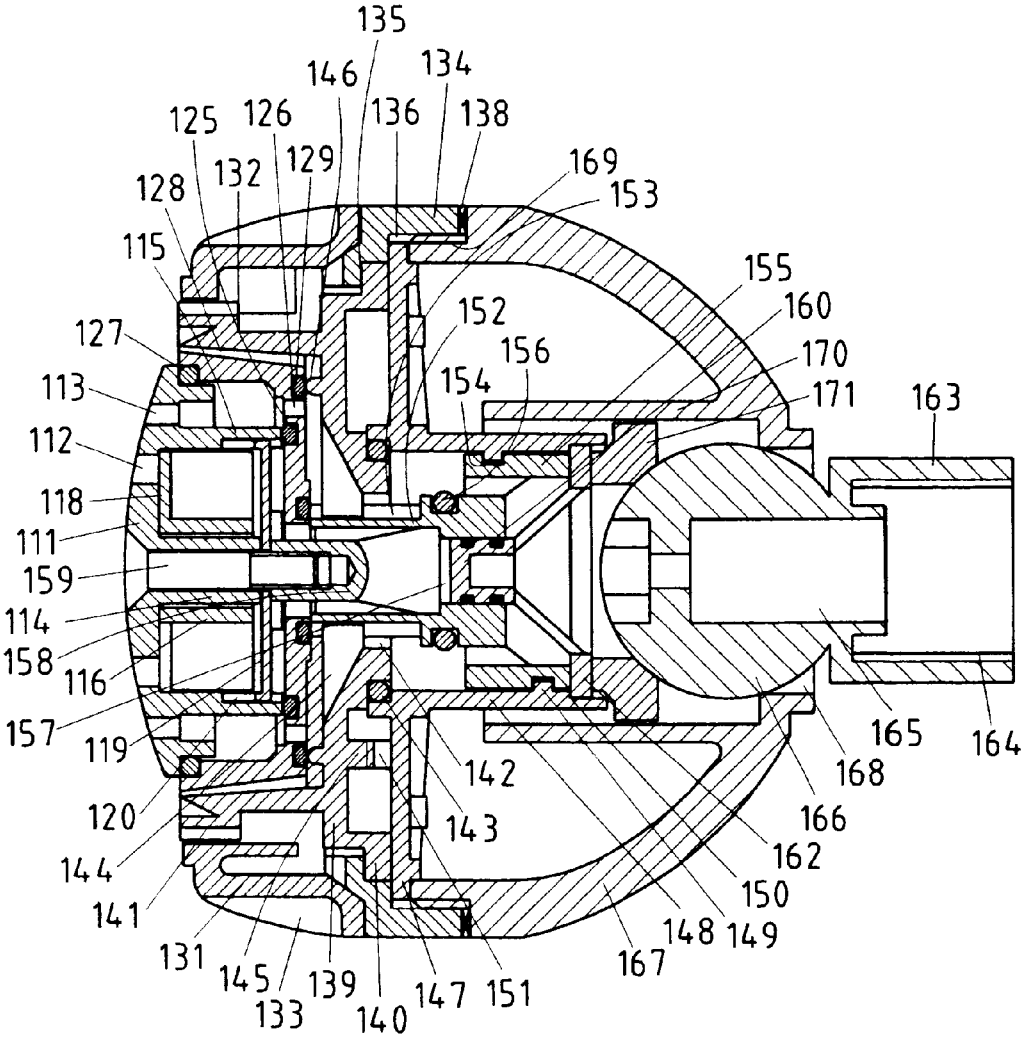
FIG. 9 shows a longitudinal sectional view of the shower head of the present invention in combination.
Figure 10:
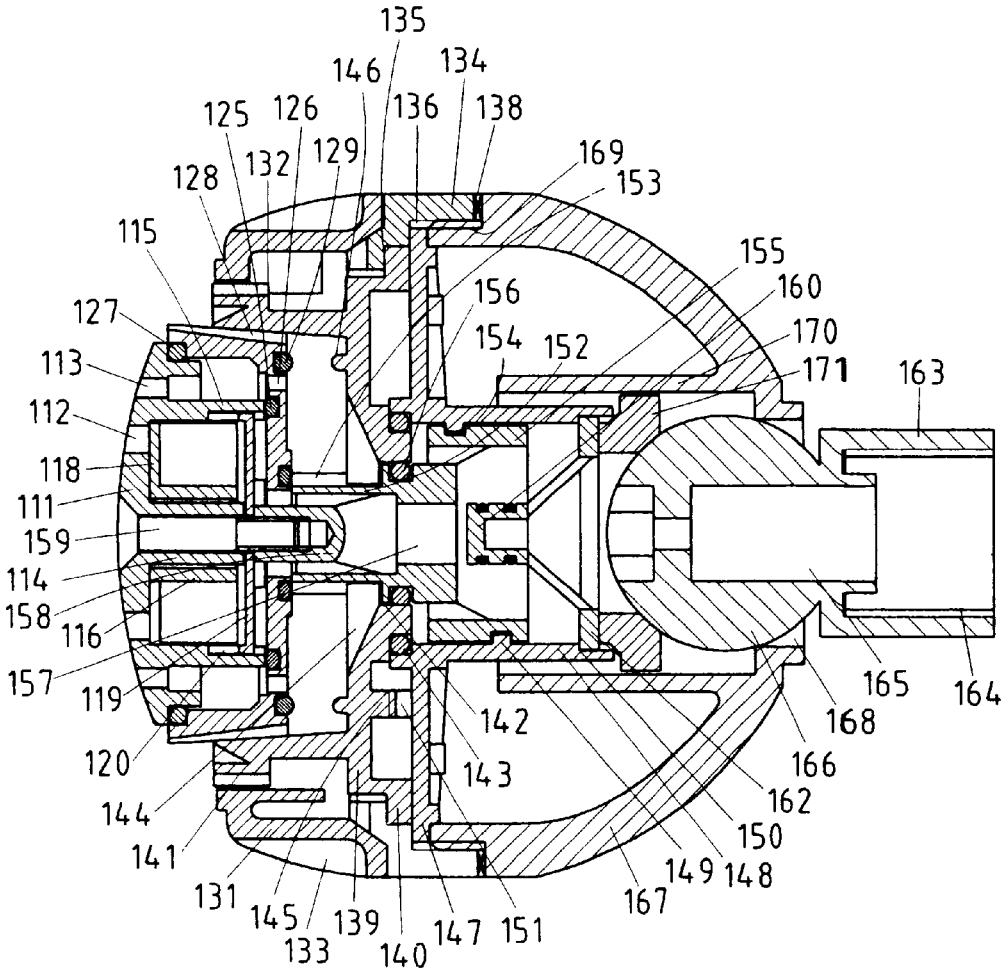
FIG. 10 shows another longitudinal sectional view of the shower head of the present invention in combination.

As shown in FIGS. 6, 7, and 8, a shower head of the preferred embodiment of the present invention comprises a front body 111, a movable circular body 122, an action member 131, a clamping member 134, a rotating seat 139, a locating member 147, a pull member 152, a valve 160, a tube connecting member 163, and a shell 167.

The front body 111 is provided with a vibrating water discharging hole 112, a water-emitting hole 113, a shaft tube 114, and a circular frame 115 located between the water discharging hole 112 and the water emitting hole 113. The shaft tube 114 is provided with a vibration member 116 and a water flow orienting member 119. The vibration member 116 is provided with a plurality of blades 117 and a baffle 118 located between two adjoining blades 117. The water flow orienting member 119 is provided with a plurality of indentations 120 and a through hole 121.

The movable circular body 122 has a center hole 123 which is provided with a plurality of ribs 124 and a washer 125 corresponding in location to the circular frame 115 of the front body 111. The washer 125 and the movable circular body 122 are provided therebetween with a plurality of water-admitting holes 126 which are circularly arranged. The front body 111 is disposed in the movable circular body 122 in conjunction with a washer 127. The movable circular body 122 is provided with a plurality of water-spraying grooves 128, and a washer 129 which is disposed on the back edge of the movable circular body 122. The center hole 123 is provided on the back edge thereof with a sealing ring 130.

The action member 131 is provided in the front end thereof with two symmetrical insertion ribs 132, and in the periphery thereof with a plurality of moving edges 133.

The clamping member 134 is engaged with the rear end of the action member 131 and provided with a first stepped edge 135, a second stopped edge 136, inner threads 137, and a self-locking edge 138 of a serrated construction.

The rotating seat 139 is provided with a circular protruded edge 140 corresponding in location to the first stepped edge 135 of the clamping member 134, and a retaining slot 141 corresponding in location to the insertion ribs 132 of the action member 131. The clamping member 134 is disposed between the action member 131 and the rotating seat 139. The rotating seat 139 is further provided with a center fitting hole 142 which is provided on the back edge thereof with a sealing ring 143, and in the inner wall thereof with a radially-oriented rib 144. The rotating seat 139 is further provided with a rotating column 145, and a circular protrusion 146 corresponding to the washer 129 of the movable circular body 122.

The locating member 147 is disposed on the second stepped edge 136 of the clamping member 134 and is provided in the center thereof with a tubular portion 148 having therein a threaded rib 149 and urging the sealing ring 143 of the rotating seat 139. The tubular portion 148 is provided in the rear end thereof with an inner stepped edge 150. The locating member 147 is further provided with an arresting column 151 corresponding in location to the rotating column 145 of the rotating seat 139.

The pull member 152 is provided with a slide slot 153 corresponding in location to the radially-oriented rib 144 of the rotating seat 139, a tubular seat 155 having a spiral groove 154 and corresponding in location to the tubular portion 148 of the locating member 147, a valve ring 156 disposed on the front edge of the tubular seat 155 such that the valve ring 156 is corresponding in location to the center fitting hole 142 of the rotating seat 139, and an axial hole 157 having a column 158 with a threaded hole. The pull member 152 is so disposed that the front end of the pull member 152 presses against the sealing ring 130 of the center hole 123 of the movable circular body 122, and that the column 158 urges the water flow orienting member 119, and further that the threaded hole of the column 158 is engaged with a fastening bolt 159 which is received in the shaft tube 114 and the through hole 121 of the water flow orienting member 119.

The valve 160 is disposed in such a manner that it corresponds in location to the axial hole 157 of the pull member 152. The valve 160 is provided with two valve rings 161 and a circular frame 162. The valve 160 is disposed in the inner stepped edge 150 of the tubular portion 148 of the locating member 147.

The tube connecting member 163 is provided therein with threads 164, and in the front end thereof with a spherical body 166 having a water admitting hole 165.

The shell 167 is provided with an end portion 168 for receiving the tube connecting member 163, and a threaded protrusion 169 corresponding in location to the inner threads 137 of the clamping member 134. The locating member 147 is disposed between the second stepped edge 136 of the clamping member 134 and the threaded protrusion 169. The shell 167 is further provided with a self-locking portion 138 of a serrated construction. The end portion 168 is provided in the front end thereof with an extension tube 170 and a sealing ring 171 which is disposed between the spherical body 166 of the tube connecting member 163 and the circular frame 162 of the valve 160.

The present invention is provided with a plurality of water emitting holes 113 which are circularly arranged around the water discharging hole 112 of the front body 111. In addition, the circular frame 115 is formed between the water discharging hole 112 and the water emitting holes 113. The movable circular body 122 is provided with the water-emitting holes 126 and the washer 125, which are corresponding in location to the circular frame 115. The water emitting holes 113 are completely separated from the vibrating water discharging hole 112 by the washer 125 and the circular frame 115. The water emitting holes 113 and the water spraying grooves 128 share the common water flow pathway, because of the washer 129 located between the water-spraying grooves 128 and the water-admitting holes 126, in conjunction with the circular protrusion 146 of the rotating seat 139. When the water-spraying grooves 128 are so adjusted that only a small amount of water is allowed to let out, a large amount of water is let out via the water-emitting holes 113. Moreover, the water is let out in various ways due to the valve rings 161 of the valve 160. The clamping member 134 is provided with the self-locking edge 138, whereas the shell 167 is provided with the self-locking portion 138 which is engaged with the self-locking edge 138 of the clamping member 134. As a result, the locating member 147 is securely located between the second stepped edge 136 of the clamping member 134 and the threaded protrusion 169 of the shell 167, Furthermore, the water leak is prevented from taking place in the end portion 168 of the shell 167 by means of the extension tube 170 in conjunction with the circular frame 162 of the valve 160 and the spherical body 166 of the tube connecting member 163. claim

I claim:

1. A spray-adjustment structure of a shower head, the spray-adjustment structure comprising:

a front body provided with a vibrating water discharging hole, a water-emitting hole, a shaft tube, and a circular frame located between said water discharging hole and said water emitting hole, said shaft tube provided with a vibration member and a water flow orienting member whereby said vibration member has a plurality of blades and a baffle located between two adjoining blades, and said water flow orienting member has a plurality of indentations and a through hole;

a movable circular body having a center hole which is provided with a plurality of ribs, and a washer corresponding in location to said circular frame of said front body whereby said washer and said movable circular body are provided therebetween with a plurality of water-admitting holes, said movable circular body provided with a plurality of water-spraying grooves, a washer which is disposed on the back edge of said movable circular body, and a sealing ring disposed on the back edge of said center hole of said movable circular body;

an action member provided in a front end thereof with a plurality of insertion ribs symmetrical to each other, and in a periphery thereof with a plurality of moving edges;

a clamping member engaged with a rear end of said action member and provided with a first stepped edge, a second stepped edge, inner threads, and a self-locking edge of a serrated construction;

a rotating seat provided with a circular protruded edge corresponding in location to said first stepped edge of said clamping member, and a retaining slot corresponding in location to said insertion ribs of said action member, said rotating seat further provided with a center fitting hole which is provided on a back edge thereof with a sealing ring, and in an inner wall thereof with a radially-oriented rib, said rotating seat further provided with a rotating column, and a circular protrusion corresponding in location to said washer of said movable circular body;

a locating member disposed on said second stepped edge of said clamping member and provided in a center thereof with a tubular portion having therein a threaded rib and urging said sealing ring of said rotating seat whereby said tubular portion is provided in a rear end thereof with an inner stepped edge, said locating member further provided with an arresting column corresponding in location to said rotating column of said rotating seat;

a pull member provided with a slide slot corresponding in location to said radially-oriented rib of said rotating seat, a tubular seat having a spiral groove and corresponding in location to said tubular portion of said locating member, a valve ring disposed on a front edge of said tubular seat such that said valve ring is corresponding in location to said center fitting hole of said rotating seat, and an axial hole having a column which is provided with a threaded hole, said pull member being so disposed that a front end of said pull member presses against said sealing ring of said center hole of said movable circular body, and that said column of said axial hole of said pull member urges said water flow orienting member of said shaft tube of said front body, and further that said threaded hole of said column of said axial hole of said pull member is engaged with a fastening bolt which is received in said shaft tube of said front body and said through hole of said water flow orienting member of said shaft tube of said front body;

a valve disposed in said inner stepped edge of said tubular portion of said locating member such that said valve is corresponding in location to said axial hole of said pull member whereby said valve is provided with two valve rings and a circular frame;

a tube connecting member provided therein with threads, and in a front end thereof with a spherical body having a water admitting hole; and a shell provided with an end portion for receiving said tube connecting member, and a threaded protrusion corresponding in location to said inner threads of said clamping member, said shell further provided with a self-locking portion of a serrated construction, said end portion of said shell provided in a front end thereof with an extension tube and a sealing ring which is disposed between said spherical body of said tube connecting member and said circular frame of said valve;

said water emitting holes of said front body being completely separated from said vibrating water discharging hole of said front body by said washer of said movable circular body and said circular frame of said front body; said water emitting holes of said front body and said water-spraying grooves of said movable circular body sharing a common water pathway due to said washer of said movable circular body being located between said water-spraying grooves of said movable circular body and said water-admitting holes of said movable circular body, in conjunction with said circular protrusion of said rotating seat; said locating member being located securely between said second stepped edge of said clamping member and said threaded protrusion of said shell due to the fact that said self-locking edge of said clamping member is engaged with said self-locking portion of said shell.

* * * * *